US005151741A

United States Patent [19]

Kakutani et al.

[11] Patent Number: 5,151,741

[45] Date of Patent: Sep. 29, 1992

[54] ELECTROPHORETIC IMAGING DEVICE

[75] Inventors: Toshiaki Kakutani; Nobuyuki Yanase; Hitoshi Fukushima; Toshiya Takahata, all of Nagano, Japan

[73] Assignee: Seiko Epson Corporation, Tokyo, Japan

[21] Appl. No.: 697,387

[22] Filed: May 9, 1991

[30] Foreign Application Priority Data

| | | | |
|---|---|---|---|
| May 14, 1990 | [JP] | Japan | 2-123283 |
| Oct. 18, 1990 | [JP] | Japan | 2-279796 |
| Oct. 18, 1990 | [JP] | Japan | 2-279797 |
| Apr. 11, 1991 | [JP] | Japan | 3-79264 |

[51] Int. Cl.[5] ..... G03G 15/04; G03G 15/10; G03G 17/04

[52] U.S. Cl. ..... 355/257; 204/299 R; 430/32

[58] Field of Search ..... 355/256, 257; 430/32, 430/34, 37; 204/299 R, 300 R

[56] References Cited

U.S. PATENT DOCUMENTS

| | | | |
|---|---|---|---|
| 3,723,288 | 3/1973 | Weigl | 355/257 X |
| 4,032,226 | 6/1977 | Groner | 355/257 |
| 4,179,209 | 12/1979 | Goren | 355/257 X |
| 4,179,290 | 12/1979 | Takahashi | 355/257 X |
| 4,230,405 | 10/1980 | Kurtz | 355/257 X |

FOREIGN PATENT DOCUMENTS

| | | |
|---|---|---|
| 43-21781 | 9/1968 | Japan . |
| 44-9870 | 5/1969 | Japan . |

*Primary Examiner*—Fred L. Braun

*Attorney, Agent, or Firm*—Sughrue, Mion, Zinn, Macpeak & Seas

[57] ABSTRACT

An electrophoretic imaging device includes an electrosensitive layer; an insulating body arranged to confront the electrosensitive layer; a developing solution filled between the electrosensitive layer and the insulating body, with the developing solution prepared by dispersing two or more kinds of electrosensitive toners into an insulating solvent; a mechanism for applying a voltage between the electrosensitive layer and the insulating body; a mechanism for irradiating a toner selection light which causes at least one kind of electrosenstivie toner to be selectively sensitizxed; and an electrosensitive layer exposing mechanism for causing image data to be photosensitively written to the electrosensitive layer. In such an electrophoretic imaging device, the electrosensitive layer is made of at least two layers, a light-shielding layer and a photoelectric charge generating layer, from a side at which the electrosensitive layer is in contact with the developing solution, and the toner selection light irradiating mechanism is provided with a filter mechanism.

3 Claims, 7 Drawing Sheets 207
105
105a
105b
206a
202
102
103
301b
301
301a
204
203
210
206b
206c
211

207
105
105a
206a
105b
202
102
103
401b
401c
401
401a
204
203
206c
206b
210
211

ELECTROPHORETIC IMAGING DEVICE

BACKGROUND OF THE INVENTION

The invention relates to an electrophoretic imaging device.

According to Japanese Patent Examined Publications Nos. 21781/1968 and 9870/1969 and the like, a Xerox-based electrophoretic imaging method or photo-electrophoretic imaging method produces a positive image and a negative image, both images being in a color that corresponds to a spectral response of an exposing light ray, on a transparent electrode and a blocking electrode, respectively, by the following way. A developing solution, in which cyan particles that are sensitive to red light; magenta particles that are sensitive to green light; and yellow particles that are sensitive to blue light are dispersed in an insulating solution, is used. And the developing solution is filled between the transparent electrode whose surface that is in contact with the developing solution is electroconductive, and the blocking electrode whose surface that is in contact with the developing solution is insulating. An electric field is applied between these electrodes so that the particles of the respective colors are attracted toward the transparent electrode, and the particles are exposed from the transparent electrode side.

However, color printing in such conventional photo-electrophoretic imaging method requires exposure involving the three primary colors: red, green, and blue. Thus, if an image is exposed using a device that can control the imaging level per pixel such as a laser device or a light-emitting diode (LED) instead of directly exposing reflected light or transmitting light from a color document, then three photosensitively writing units, each of which emits light for each primary color, must be prepared.

SUMMARY OF THE INVENTION

The invention has been made in view of the above circumstances. Accordingly, an object of the invention is to provide an electrophoretic imaging device capable of easily producing a full-color image even if a photosensitively writing device whose light-emitting wavelength cannot be changed easily such as a laser device or an LED is used.

To achieve the above object, a first aspect of the invention is applied to an electrophoretic imaging device which includes: an electrosensitive layer and an insulating body which are arranged so as to confront each other and between which a developing solution is filled, the developing solution being prepared by dispersing N or more kinds of electrosensitive toners (where N is an integer equal to or greater than 2) into an insulating solvent; a voltage applying mechanism for applying a voltage between the electrosensitive layer and the insulating body; a toner selection light irradiating mechanism for irradiating toner selection light which selectively sensitizes at least one kind of electrosensitive toner; and an electrosensitive layer exposing mechanism for causing image data to be photosensitively written to the electrosensitive layer. In such an electrophoretic imaging device, the electrosensitive layer is made of at least two layers, a light-shielding layer and a photoelectric charge generating layer, which are arranged in the written order from a side at which the electrosensitive layer is in contact with the developing solution.

A second aspect of the invention is applied to an electrophoretic imaging device which includes: an electrosensitive layer and an insulating body which are arranged so as to confront each other and between which a developing solution is filled, the developing solution being prepared by dispersing N or more kinds of electrosensitive toners (where N is an integer equal to or greater than 2) into an insulating solvent; a voltage applying mechanism for applying a voltage between the electrosensitive layer and the insulating body; a toner selection light irradiating mechanism for irradiating toner selection light which selectively sensitizes at least one kind of electrosensitive toner; and an electrosensitive layer exposing mechanism for causing image data to be photosensitively written to the electrosensitive layer. In such an electrophoretic imaging device, the electrosensitive layer is made of at least two layers: a photoelectric charge generating layer and an electric charge transferring layer. The electric charge transferring layer is arranged closer to the insulating body than the photoelectric charge generating layer and has a light-shielding property.

A third aspect of the invention is applied to an electrophoretic imaging device which includes: an electrosensitive layer and an insulating body which are arranged so as to confront each other and between which a developing solution is filled, the developing solution being prepared by dispersing N or more kinds of electrosensitive toners (where N is an integer equal to or greater than 2) into an insulating solvent; a voltage applying mechanism for applying a voltage between the electrosensitive layer and the insulating body; a toner selection light irradiating mechanism for irradiating toner selection light which selectively sensitizes at least one kind of electrosensitive toner; and an electrosensitive layer exposing mechanism for causing image data to be photosensitively written to the electrosensitive layer. In such an electrophoretic imaging device, the electrosensitive layer is made of at least three layers: an electric charge transferring layer, a light-shielding layer, and a photoelectric charge generating layer, which are arranged in the written order from a side at which the electrosensitive layer is close to the insulating body.

A fourth aspect of the invention is applied to an electrophoretic imaging device which includes: an electrosensitive layer and an insulating body which are arranged so as to confront each other and between which a developing solution is filled, the developing solution being prepared by dispersing N or more kinds of electrosensitive toners (where N is an integer equal to or greater than 2) into an insulating solvent; a voltage applying mechanism for applying a voltage between the electrosensitive layer and the insulating body; a toner selection light irradiating mechanism for irradiating toner selection light which selectively sensitizes at least one kind of electrosensitive toner; and an electrosensitive layer exposing mechanism for causing image data to be photosensitively written to the electrosensitive layer. In such an electrophoretic imaging device, the toner selection light irradiating mechanism is provided with a filter mechanism.

DETAILED DESCRIPTION OF THE PREFERRED EMBODIMENTS

Figure 1:
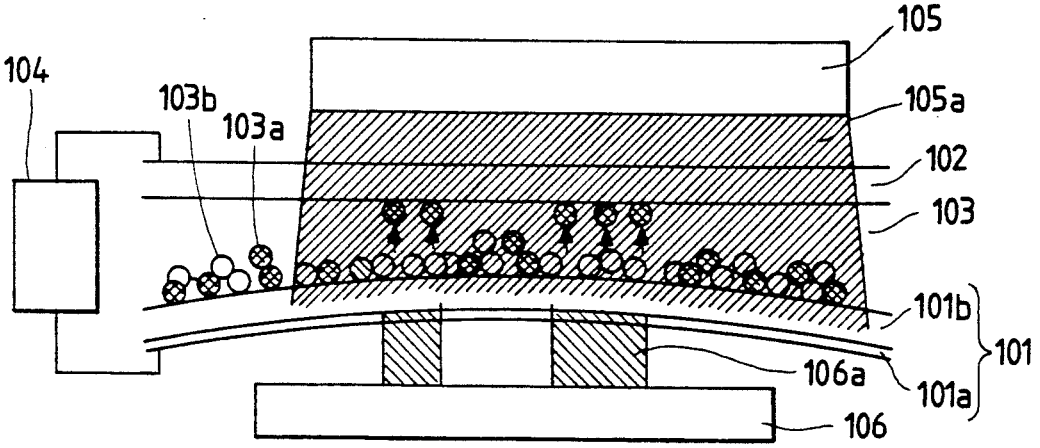
FIG. 1 is a diagram illustrative of an operation of the invention.

First, an operation of the invention will be described with reference to FIG. 1.

Let it now be assumed that a developing solution 103 is used. The developing solution 103 is prepared by dispersing into an insulating solvent an electrosensitive toner Tl 103*a* which is sensitive to light A having a certain spectral distribution and which is not sensitive to light B having a spectral distribution that is different from the spectral distribution of the light A; and an electrosensitive toner T2 103*b* which is sensitive to the light B and which is not sensitive to the light A. It is also assumed that the toner T1 103*a* and the toner T2 103*b* are negatively charged initially.

This developing solution 103 is filled between the insulating body 102 and the electrosensitive layer 101, and a voltage is applied from the voltage applying mechanism 104 so that the electrosensitive layer 101 has a higher potential than the insulating body 102. As a result, the toners Tl 103*a*, T2 103*b* which have negatively been charged are caused to electrophoretically migrate toward the electrosensitive layer 101 by an electrostatic force.

The toner selection light irradiating mechanism 105 can irradiate the light A and/or light B selectively, and if it is only the light A that is irradiated to the developing solution 103 as a toner selection light, then it is only the toner T1 103*a* that is sensitized, causing itself to be electrically activated. However, under this condition, the photoelectric charge generating layer 101*a* has not yet been sensitized, and this causes the electrosensitive layer 101 to serve as an insulator, keeping most electric charges from migrating. As a result, introduction of the migrated electric charges to the toner T1 103*a* is not sufficient to invert the polarity of the toner T1 103*a*.

Thus, while irradiating the light A as a toner selection light, an image forming portion in the photoelectric charge generating layer 101*a* of the electrosensitive layer 101 is exposed and sensitized by the electrosensitive layer exposing mechanism 106. As a result, such portion gets electrically activated, making the generated electric charges to be capable of migrating toward the developing solution via the light-shielding layer 101*b*. This increases the chance of exchanging electric charges between such portion in the photoelectric charge generating layer 101*a* and the toner T1 103*a* that has selectively been activated by the irradiation of the toner selection light, thereby causing the polarity of the toner T1 103*a* to invert. The toner T1 103*a* whose polarity has been inverted is then electrophoretically migrated toward the insulating body 102 as indicated by the arrows shown in FIG. 1 by the electrostatic force and eventually adheres to the insulating body 102. As a result, a negative image of the toner T1 103*a* is formed on the insulating body 102 and a positive image thereof, on the electrosensitive layer 101. Accordingly, it is only when the toner is sensitized by its corresponding toner selection light and only when the photoelectric charge generating layer 101*a* is sensitized by the electrosensitive layer exposing light that the electrically charged toner particles invert their polarity and electrophoretically migrate.

According to the first aspect of the invention, the light-shielding layer 101*b* is arranged on the side at which the electrosensitive layer 101 is in contact with the developing solution. Therefore, it is less likely for the toner selection light to sensitize the photoelectric charge generating layer or for the electrosensitive layer exposing light to sensitize the toner.

An image with the toner T2 103*b* can similarly be produced when the light B, instead of the light A, is used as a toner selection light.

The switching of toner selection lights by the toner selection light irradiating mechanism in the above-described way allows selection of a kind of toner with which to cause an image to be formed by the electrosensitive layer exposing mechanism.

If it is so arranged that a toner exhibiting sensitivity to a wavelength range different from those of the toners T1 103*a*, T2 103*b* is added and that the toner selection light irradiating mechanism can selectively irradiate light that sensitizes such added toner, then the kind of toner to be selected can be increased. This allows full-color printing to be performed by using a developing solution containing toners for three or more colors.

While the case where the toner is initially negatively charged has been taken as an example in the above description, the same advantage can be obtained even in the case where the toner is positively charge initially as long as a voltage is applied from the voltage applying mechanism so that the insulating body has a higher potential than the electrosensitive layer.

According to the second aspect of the invention, instead of the electrosensitive layer 101 consisting of the photoelectric charge generating layer 101*a* and the light-shielding layer 101*b*, the electrosensitive layer has at least a two-layer structure consisting of the photoelectric charge generating layer and the electric charge transferring layer, and the electric charge transferring layer that has a light-shielding property is interposed between the photoelectric charge generating layer and the electrosensitive toner. Therefore, interference of the toner selecting light with the electrosensitive layer exposing light can be prevented.

According to the third aspect of the invention, instead of the electrosensitive layers used in the first and second aspects of the invention, the electrosensitive layer is constructed so that the light-shielding layer is interposed between the photoelectric charge generating layer and electric charge transferring layer. Therefore, it is less likely for the toner selection light to sensitize the photoelectric charge generating layer or for the electrosensitive layer exposing light to sensitize the toner. Further, the electric charge transferring layer of the electrosensitive layer is made of a material having a hole-transferring property when the toner is negatively charged initially, while the electric charge transferring layer is made of a material having an electron-transferring property when the toner is positively charged initially.

According to the fourth aspect of the invention, the color of toner to be developed can be selected only by switching the toner selection lights using the toner selection light irradiating mechanism even if an image is exposed by a single electrosensitive layer exposing mechanism. Therefore, it is no longer required that the electrophoretic imaging device have a plurality of electrosensitive layer exposing mechanisms per color, nor is it required that a different developing solution be used per color, hence allowing a color imaging device with a simple construction to be achieved.

Embodiments of a color electrophoretic imaging device of the invention will be described with reference to the accompanying drawings.

Figure 2:
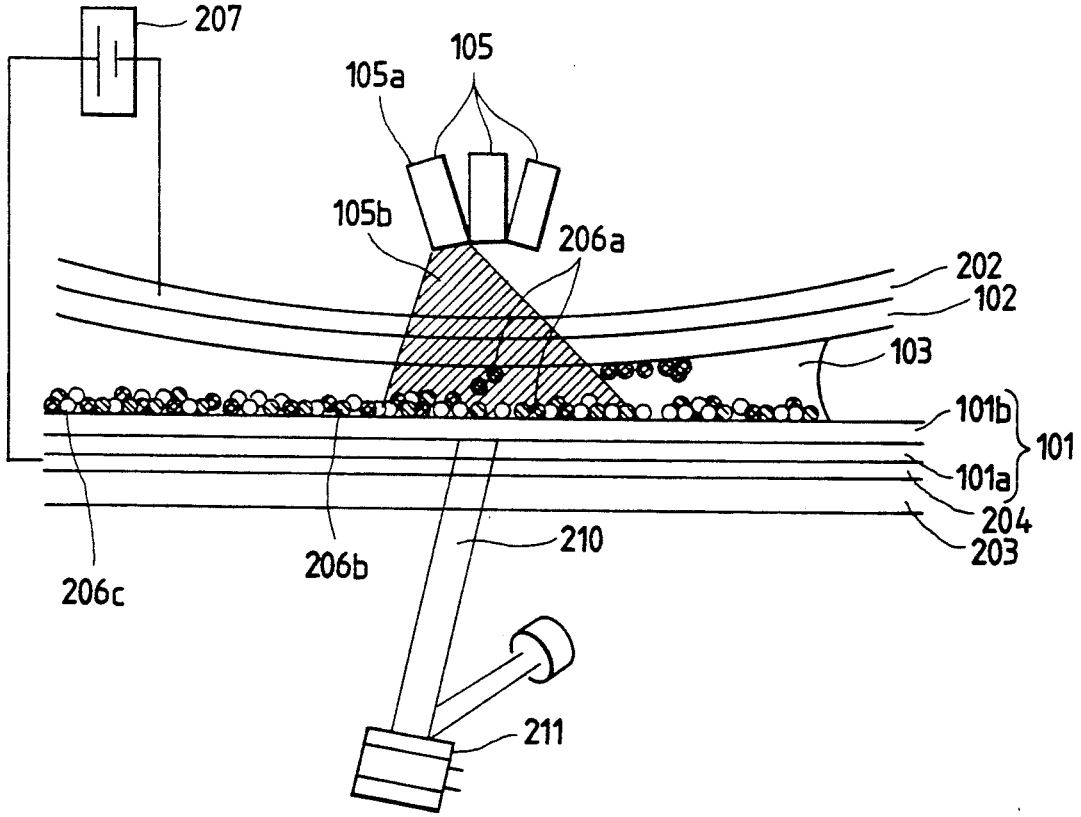
FIG. 2 is a diagram showing a first embodiment of the invention.

FIG. 2 is a diagram showing a first embodiment of the invention.

In FIG. 2, an insulating body 102 is a transparent insulating film. A polyethylene terephthalate (PET) film is used. On an upper surface of the insulating body 102 is a transparent electrode 202 formed of an indium-tin oxide (ITO) coating.

On a supporting body 203 are a transparent electrode 204 and an electrosensitive layer 101 formed with the electrosensitive layer 101 consisting of two layers: a photoelectric charge generating layer 101*a* and a light-shielding layer 101*b*. The supporting body 203 is formed of a PET film, while the electrode 204 is made of a transparent ITO film. The photoelectric charge generating layer 101*a* is made of an organic photosensitive film in which a pigment such as phthalocyanine is dispersed in a resin and exhibits sensitivity in the near infrared light range. The light-shielding layer 101*b* is prepared by dispersing an appropriate equivalent weight of carbon in a polycarbonate resin and possesses a light-shielding property in the visible and near infrared light ranges.

A developing solution 103 is prepared by dispersing three kinds of electrosensitive toners into an insulating solvent such as kerosene. The three kinds of electrosensitive toners are: a cyan toner 206*a* that is sensitive to red light; a magenta toner 206*b* that is sensitive green light; and a yellow toner 206*c* that is sensitive to blue light. These toners are negatively charged initially.

A voltage applying mechanism serves to apply a voltage between the electrode 202 and the electrode 204 from a power source 207 so that the insulating body 102 is at a low potential and that the electrosensitive layer 101 is at a high potential. An electric field generated by this voltage applying mechanism causes the negatively charged toners to electrophoretically migrate toward the electrosensitive layer 101.

A toner selection light irradiating mechanism 105 has light-emitting diodes (LEDs) of three colors, red, green, and blue, arranged. A red LED 105*a* is turned on to develop a cyan toner timage; a yellow LED is turned on to develop a yellow toner image; and a green LED is turned on to develop a magenta toner image. Rays of light from each LED for irradiating the corresponding toner layer from above form a toner selection light 105*b*. In FIG. 2 rays of red light for selecting the cyan toner are irradiated.

An electrosensitive layer exposing mechanism exposes the photoelectric charge generating layer 101*a* by scanning a laser beam 210 of a near infrared wavelength while causing it to be reflected by a polygon mirror 211.

To form a cyan toner image with the above construction, while turning on the red LED 105*a* as a toner selection light, a laser beam is irradiated only to a targeted toner image forming portion by scanning. As a result, a negative image with the cyan toner is formed on the insulating body 102, while a positive image therewith is formed on the electrosensitive layer 101. Similarly, to form a magenta toner image, the green LED is turned on and to form a yellow toner image, the blue LED is turned on as toner selection lights, respectively, and the laser beams 210 are scanned. Accordingly, a full-color image using the three primary colors, cyan, magenta, and yellow, can be produced by switching the toner selection lights and exposing the electrosensitive layer 101 three times. The method of switching the toner selection lights may be pixel-sequential, line-sequential, or frame-sequential. Any image, either the positive image on the electrosensitive layer 101 or the negative image on the insulating body 102, may be used for producing an image. The respective negative toner images formed on the insulating body 102 may be subjected to a multiple development in which the respective color toner images are developed by overlapping at a single point, or to a development in which the respective color toner images are developed separately, color by color, and in which the thus developed toner images are caused to overlap each other on a single transferring medium in a subsequent process such as a transfer process.

Figure 3:
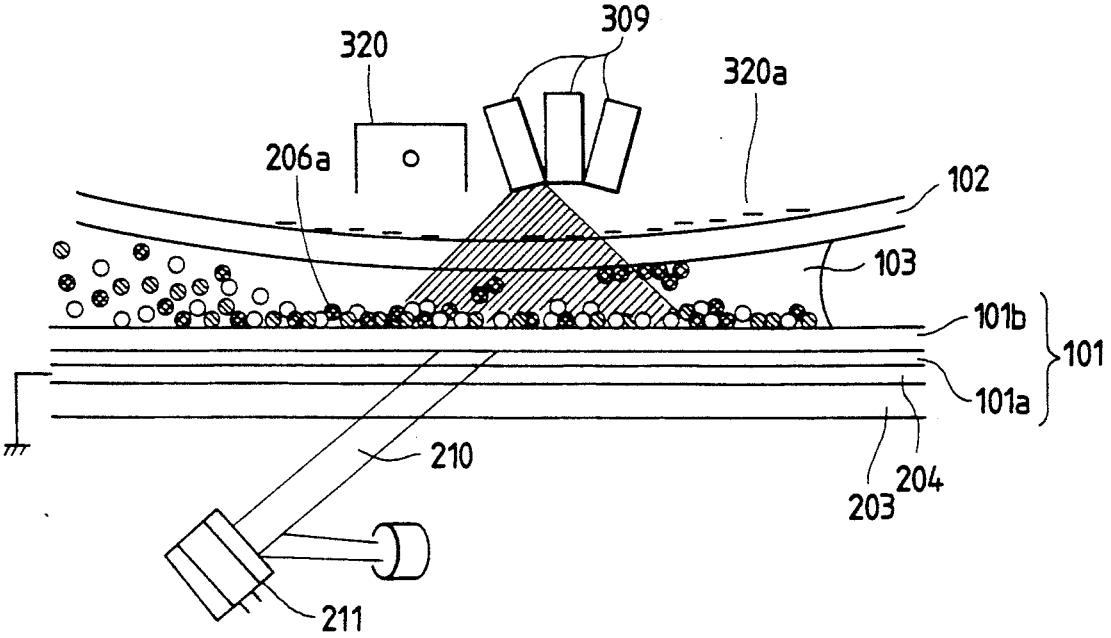
FIG. 3 is a diagram showing a second embodiment of the invention.

FIG. 3 is a diagram showing a second embodiment of the invention. In this embodiment the voltage applying mechanism is so constructed that negative charges 320*a* are stored on the back of the insulating body 102 using a corona discharge device 320 in place of the power source 207 shown in FIG. 2. Other than by using the corona discharge device 320, a voltage may be applied by electrifying the insulating body 102 while causing the insulating body 102 to touch an electrode having an appropriate potential or the like. While the electrode 204 is grounded in the second embodiment, it may also be the electrode 204 that is electrically charged to an appropriate potential by the corona discharge device or the like.

Figure 4:
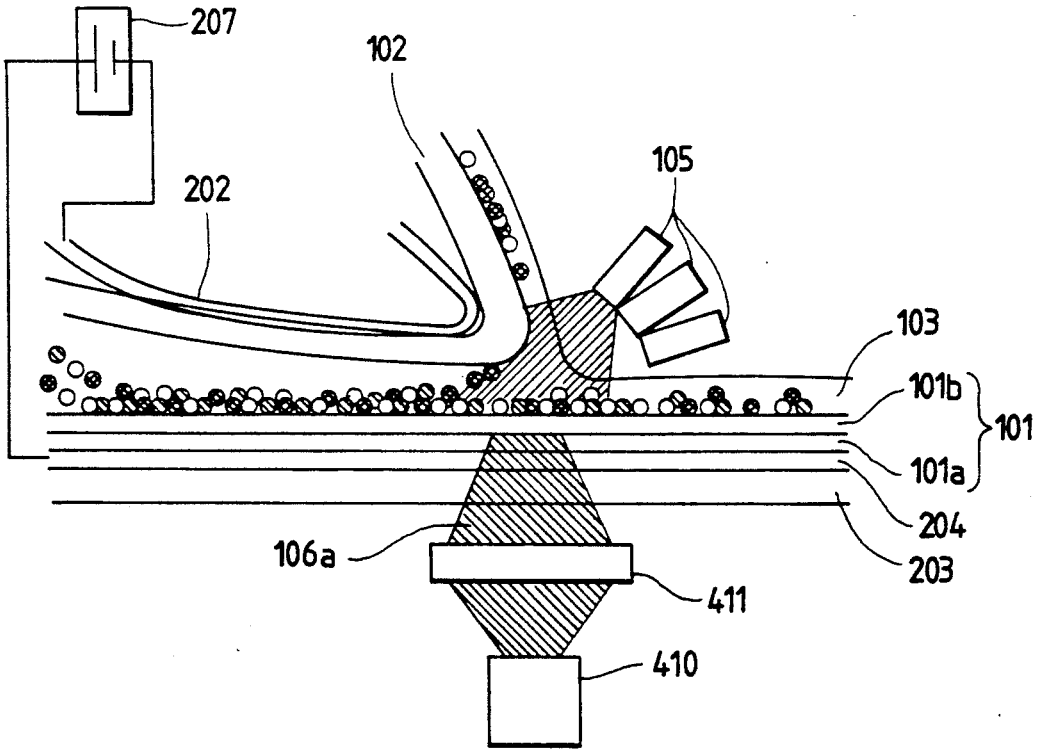
FIG. 4 is a diagram showing a third embodiment of the invention.

FIG. 4 is a diagram showing a third embodiment of the invention. The distance between the electrosensitive layer 101 and the insulating body 102 is widened in the vicinity of a developing section so that a toner selection light can be irradiated directly to the developing section without passing through the electrosensitive layer 101 and the insulating body 102.

The electrosensitive layer exposing mechanism of the third embodiment is formed of an LED array 410 having a multiplicity of LEDs arranged in one-dimensional form. Exposure is performed by irradiating an electrosensitive layer exposing light 106*a* from the LED array 410 to cause an image to be formed on the electrosensitive layer 101 by an imaging optical system 411. In the third embodiment, the insulating body 102 and the electrode 202 are not necessarily made of transparent materials, respectively. Thus, the electrode 202 may be made of a material such as aluminum. While the insulating body 102 is bent rather than flat, it may, instead, be the electrosensitive layer 101 that is bent. The insulating body 102 and the electrosensitive layer 101 may be cylindrical or the like.

While the developing solution in which the three kinds of toners, cyan, magenta, and yellow, that are respectively sensitized by the red, green, and blue toner selection lights, are dispersed is used in the above embodiments, the toner selection lights and the toner colors are not limited thereto; toner selection lights in the infrared and ultraviolet light ranges may also be used. In addition, there is no limitation in the combination of a sensitizing light and a sensitized color. It may also be so arranged that an initially sensitized color can be changed to a different color by a post-development coloring process while using a kind of toner containing a leuco-containing dye. Four or more toner colors may be used, and only selected two colors of toner may be used if a full-color image reproduction is not required. An exemplary combination of such a developing solution will consist of four kinds of electrosensitive toners which provide the final four colors, cyan, magenta, yellow, and black after having been sensitized by such toner selection lights as infrared, red, green, and blue.

The toner selection light irradiating mechanism 105 may at least be such that a toner selection light corresponding to a desired kind of toner can be irradiated. Instead of using the LEDs of a plurality of colors which emit the respective toner selection lights as in the embodiments shown in FIGS. 2 to 4, various kinds of light sources including a cold cathode-ray tube (CRT) and an electroluminescent light source may be used. Use of a color CRT allows a plurality of kinds of toner selection lights to be irradiated from a single source of light. Combination of a light source incorporating a multiplicity of wavelength components such as a cool white fluorescent lamp or a halogen lamp and a filter transmitting only a desired wavelength component allows the toner selection lights to be selectively switched as long as it is so arranged that a filter can be selected from a group of such filters.

In the invention no limitation is imposed on the toner selection light switching sequence. The toner selection lights may be switched image by image via a frame sequential method, or line by line, or pixel by pixel. Only a toner selection light corresponding to a desired color may be selected to expose and develop an image if the image is not required to be reproduced on a full-color basis.

Further, the voltage applying mechanism 104 may be constructed so that the insulating body 102 has a high potential and the electrosensitive layer 101 has a low potential by inverting the polarity set in the above embodiments. Other than organic photosensitive bodies, materials with various spectral responses such as amorphous silicon and selenium may be used as the photoelectric charge generating layer 101*a*.

The material and structure of the light-shielding layer 101*b* is not particularly limited. Conceivable examples are a material in which an appropriate coloring matter is dispersed in a resin or the like, and a multilayer structure whose thickness is so controlled as to allow a specific wavelength range to be dampened by interference. However, the material must possess, in addition to the light-shielding property, such electroconductivity and electric charge transferability as not to prevent electric charges generated at the photoelectric charge generating layer 101*a* from migrating toward the toner. The light-shielding property of the light-shielding layer 101*b* does not necessarily require nearly 100% shielding of light rays in the full range of wavelengths. The advantage of reducing negative influence from leaked light can be provided as long as its light transmittance is 30% or less at least in one of the following wavelength ranges. The wavelength ranges are: a wavelength range where a light wavelength to which the photoelectric conversion generating layer 101*a* is sensitive overlaps a wavelength distribution of a toner selection light; and a wavelength range where a wavelength distribution of an electrosensitive layer exposing light overlaps a light wavelength by which the toner is sensitized.

In addition to the light-shielding layer 101*b* and the photoelectric charge generating layer 101*a*, the electrosensitive layer 101 may have other layers which assume certain functions, or the light-shielding layer 101*b* may have a function other than the light-shielding property. To improve the insulating property in the absence of exposure, the following examples are conceivable. That is, if the toner electrifying potential before inversion of the electric charge is negative, a hole-transferable layer may be arranged between the light-shielding layer and the photoelectric charge generating layer, or hole-transferability may be conferred to the light-shielding layer, and if the toner electrifying potential is positive before inversion of the electric charge, electron-transferability may be conferred instead of the hole-transferability.

As the electrosensitive layer exposing mechanism, various devices such as an LED, a CRT, other than laser, may be used. Combination of a shutter element such as a liquid-crystal shutter with other light source may also be applicable. Other than exposing an entire frame by scanning a single beam as in the above embodiments shown in FIGS. 2 and 3, an exposing mechanism having a plurality of exposing elements arranged in one-dimensional or two-dimensional form may also be used. Photo scanning may be performed by causing the light source and/or the electrosensitive layer to move. The exposing wavelength is not necessarily in the near infrared light range but may be light of any spectral response as long as it can sensitize the electrosensitive layer.

A fourth embodiment of the invention will be described with reference to FIG. 5.

In the fourth embodiment, a transparent electrode 204 and an electrosensitive layer 301 are formed on a supporting body 203, and the electrosensitive layer 301 consists of two layers: a photoelectric charge generating layer 301*a* and an electric charge transferring layer 301*b*. The electric charge transferring layer 301*b* is made of a biphenyl hydrazone derivative, a polycarbonate resin, or a carbon black pigment, and has not only a hole-transferring property that makes holes more susceptible to migration than electrons but also a light-shielding property in the visible and near infrared light ranges.

In the invention, the material and structure of the electric charge transferring layer 301*b* is not particularly limited. Its light-shielding property does not necessarily require nearly 100% shielding of light rays in the full range of wavelengths. The advantage of reducing interference can be provided as long as its light transmittance is 30% or less at least in one of the following wavelength ranges. The wavelength ranges are: a wavelength range where a light wavelength to which the photoelectric conversion generating layer 101*a* is sensitive overlaps a wavelength distribution of a toner selection light; and a wavelength range where a wavelength distribution of an electrosensitive layer exposing light overlaps a light wavelength by which the toner is sensitized. Further, while the combination of the toner and the electric charge transferring layer having the hole-transferring property is used by charging the toner negatively before development in this embodiment, combination of the toner that is positively charged before development and the electric charge transferring layer having the electron-transferring property may instead be used. In such a case, the polarity of the voltage applying mechanism must be inverted so as to have a higher potential at the insulating body. Moreover, usable as a photoelectric charge generating layer are materials exhibiting a variety of spectral responses such as amorphous silicon and selenium, other than organic photosensitive bodies.

A fifth embodiment of the invention will be described with reference to FIG. 6.

In the fifth embodiment, a transparent electrode 204 and an electrosensitive layer 401 are formed on a supporting body 203, and the electrosensitive layer 401 consists of three layers a photoelectric charge generating layer 401*a*, a light-shielding layer 401*c*, and an electric charge transferring layer 401*b*. The electric charge transferring layer 401*b* is made of a biphenyl hydrazone derivative, a polycarbonate resin, or the like, and has a hole-transferring property that makes holes more susceptible to migration than electrons.

A layer having a different function may also be added in addition to the electric charge transferring layer, the light-shielding layer, and the photoelectric charge generating layer.

Further, while the combination of the toner and the electric charge transferring layer having the hole-transferring property is used by charging the toner negatively before development in this embodiment, combination of the toner that is positively charged before development and the electric charge transferring layer having the electron-transferring property may instead be used. In such a case, the polarity of the voltage applying mechanism must be inverted so as to have a higher potential at the insulating body. Moreover, usable as a photoelectric charge generating layer are materials exhibiting a variety of spectral responses such as amorphous silicon and selenium, other than organic photosensitive bodies.

Figure 5:
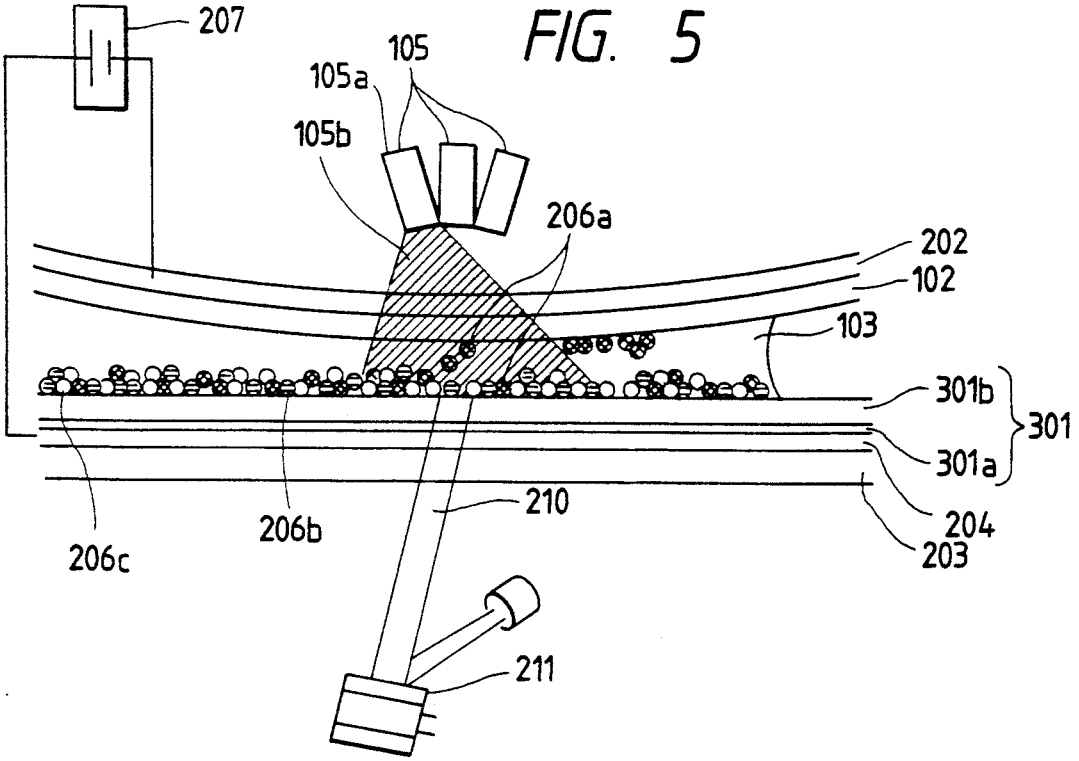
FIG. 5 is a diagram showing a fourth embodiment of the invention.
Figure 6:
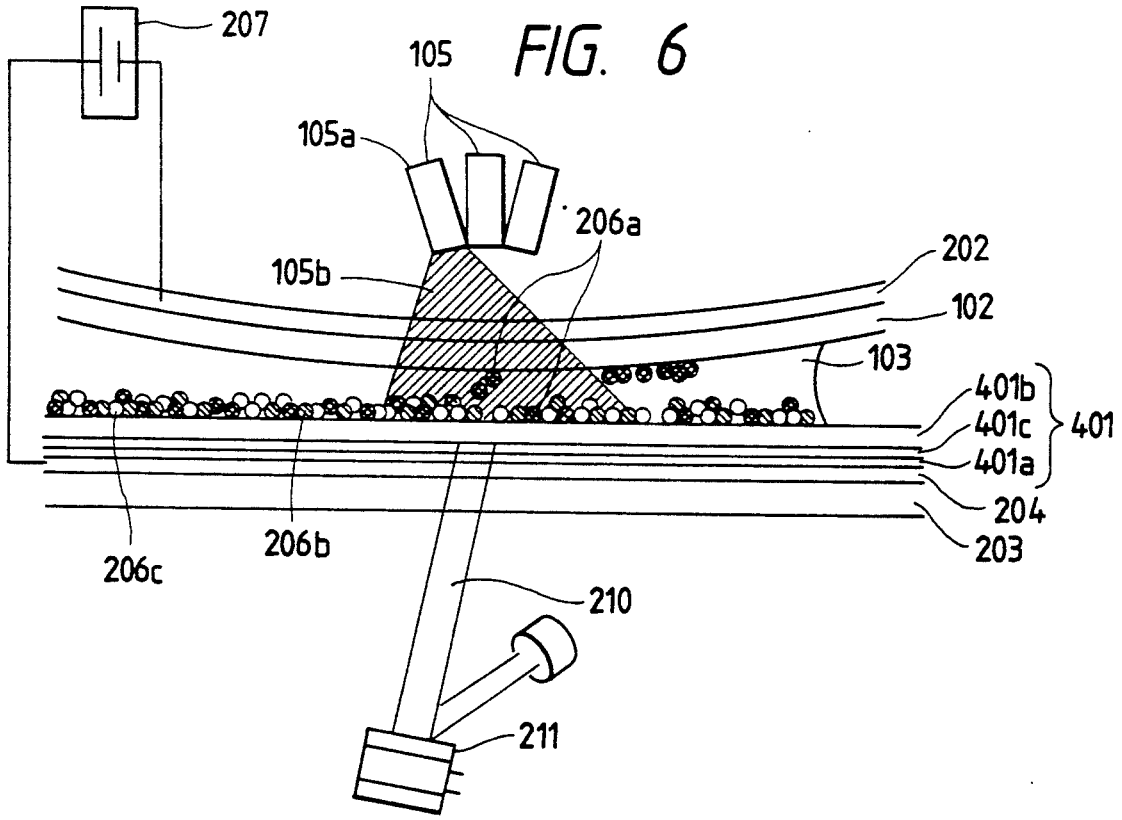
FIG. 6 is a diagram showing a fifth embodiment of the invention.

The electrosensitive layers 301 and 401 used in the embodiments of FIGS. 5 and 6 are applicable to the embodiments of FIGS. 3 and 4, instead of the electrosensitive layers 101, respectively.

A sixth embodiment of the invention will be described with reference to FIGS. 7 to 13.

Figure 7:
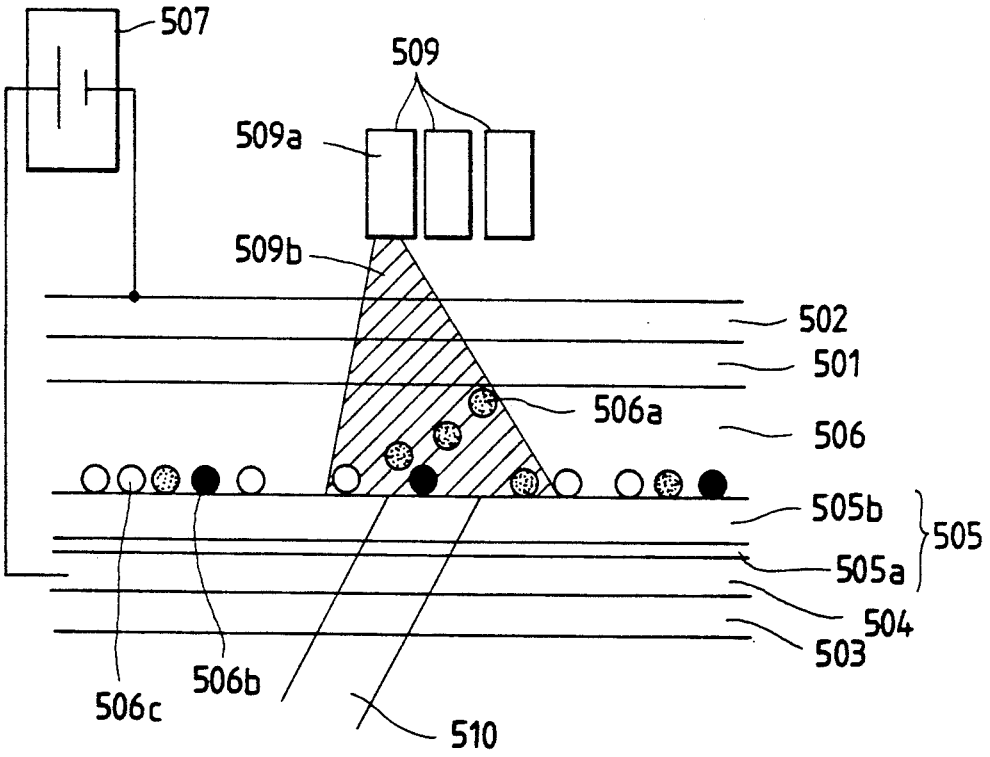
FIG. 7 is a diagram showing a sixth embodiment of the invention.

FIG. 7 is a diagram showing the sixth embodiment of the invention. In FIG. 7, an insulating body 501 is a transparent insulating film. A PET film is used. On the upper surface of the insulating body 501 is a transparent electrode 502 formed of an ITO coating.

On a supporting body 503 are a transparent electrode 504 and an electrosensitive layer 505 formed with the electrosensitive layer 505 consisting of two layers: a photoelectric charge generating layer 505*a* and an electric charge transferring layer 505*b*. The supporting body 503 is formed of a PET film, while the electrode 504 is made of a transparent ITO film. The photoelectric charge generating layer 505*a* is made of an organic photosensitive film in which a pigment such as phthalocyanine is dispersed in a resin and it exhibits sensitivity in the near infrared light range. The electric charge transferring layer 505*b* is made of a biphenyl hydrazone derivative, a polycarbonate resin, or a carbon black pigment, and has not only a hole-transferring property that makes holes more susceptible to migration than electrons but also a light-shielding property in the visible and near infrared light ranges.

A developing solution 506 is prepared by dispersing three kinds of electrosensitive toners into an insulating solvent such as kerosene. The three kinds of electrosensitive toners are: a cyan toner 506*a* that is sensitive to red light; a magenta toner 506*b* that is sensitive to green light; and a yellow toner 506*c* that is sensitive to blue light. These toners are negatively charged initially.

A voltage applying mechanism serves to apply a voltage between the electrode 502 and the electrode 504 from a power source 507 so that the insulating body 501 is at a low potential and that the electrosensitive layer 505 is at a high potential. An electric field generated by this voltage applying mechanism causes the negatively charged toners to electrophoretically migrate toward the electrosensitive layer 505.

A toner selection light irradiating mechanism 509 consists of line-shaped halogen lamps of three colors: red, green, and blue. Each halogen lamp is provided with a filter mechanism. A red lamp 509*a* is turned on to develop a cyan toner image; a blue lamp is turned on to develop a yellow toner image; and a green lamp is turned on to develop a magenta toner image. Rays of light to be irradiated from top to the corresponding toner layer forms a toner selection light 509*b*. In FIG. 7 rays of red light for selecting the cyan toner are irradiated.

An electrosensitive layer exposing mechanism exposes the photoelectric charge generating layer 505*a* of the electrosensitive layer 505 by scanning a laser beam 510 of a near infrared wavelength.

To form a cyan toner image with the above construction, while turning on the red lamp 509*a* as a toner selection light, a laser beam is irradiated only to a targeted toner image forming portion by scanning. As a result, a negative image with the cyan toner is formed on the insulating body 501, while a positive image therewith is formed on the electrosensitive layer 505. Similarly, to form a magenta toner image, the green lamp is turned on and to form a yellow toner image, the blue lamp is turned on as toner selection lights, respectively, and the laser beams 510 are scanned. Accordingly, a full-color image using the three primary colors, cyan, magenta, and yellow, can be produced by switching the toner selection lights and exposing the electrosensitive layer 505 three times. Any image, either the positive image on the electrosensitive layer 505 or the negative image on the insulating body 501, may be used for producing an image. The respective negative toner images formed on the insulating body 501 may be developed separately, color by color, and each thus developed toner image may be caused to overlap each other on a single transferring medium in a subsequent transfer process.

Figure 8:
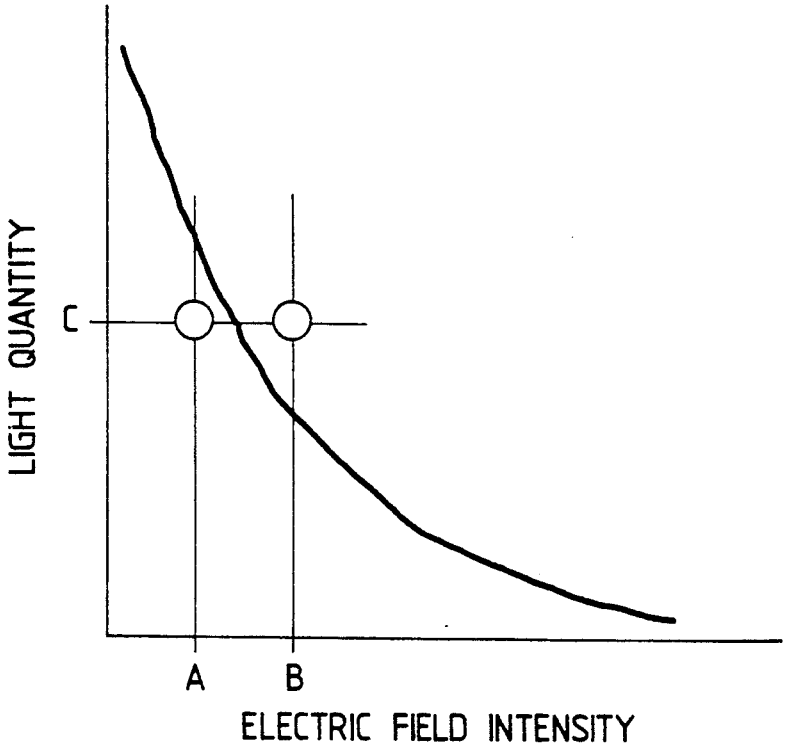
FIG. 8 is a diagram showing a light movement curve.
Figure 9:
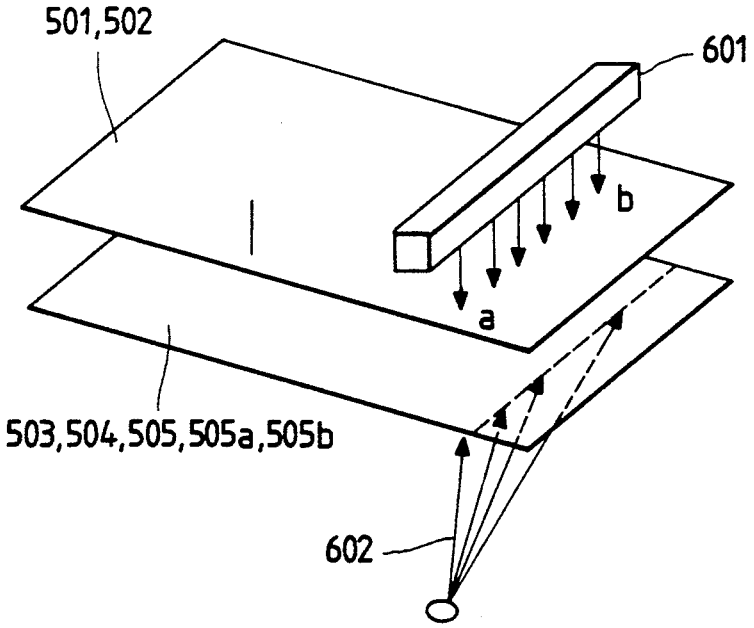
FIG. 9 is a diagram illustrative of an exposing mechanism.
Figure 10:
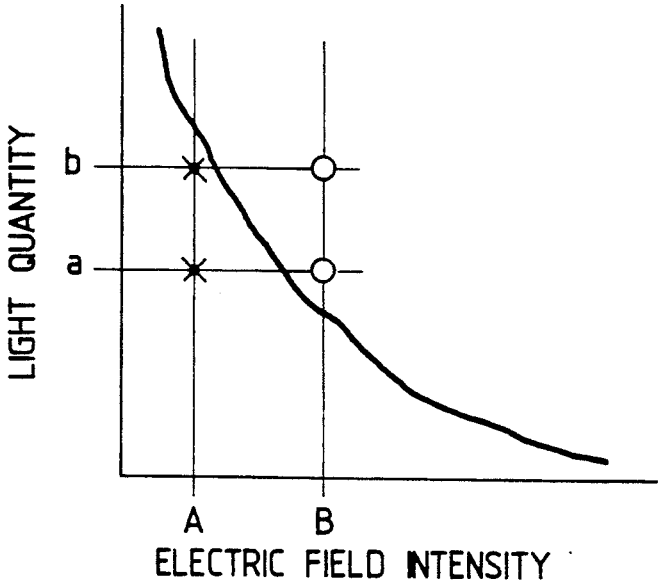
FIG. 10 is a diagram showing a position-dependent difference in the amount of light at the time of writing using a laser beam.
Figure 11:
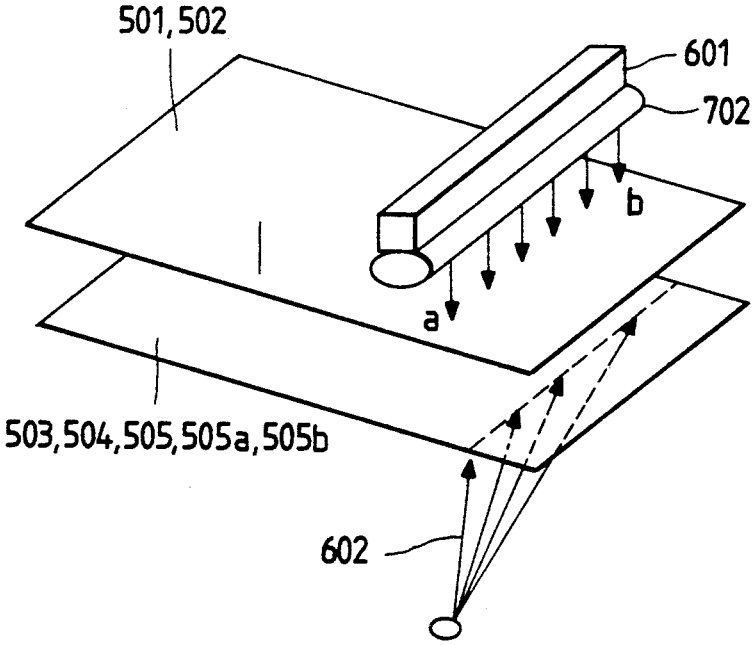
FIG. 11 is a diagram illustrative of the exposing mechanism including a filter mechanism of the invention.
Figure 12:
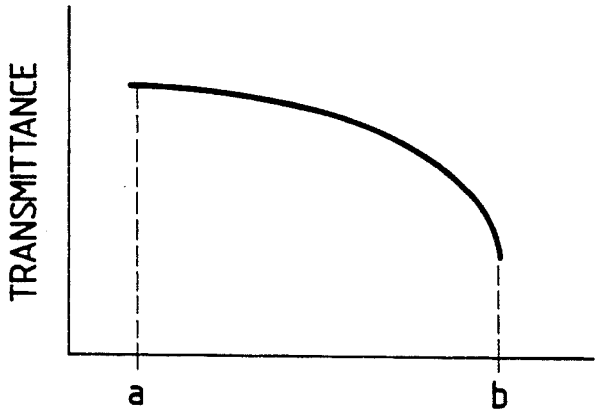
FIG. 12 is a diagram showing the transmittance of a filter.
Figure 13:
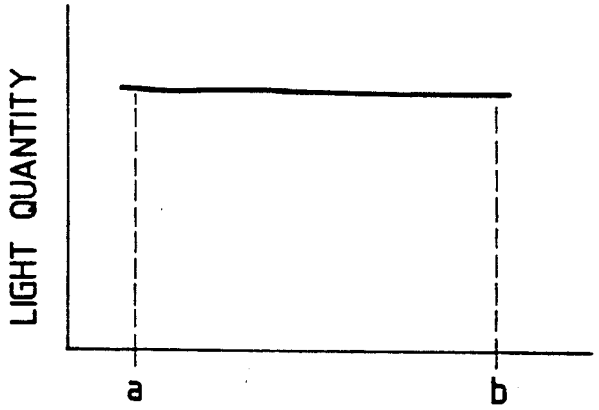
FIG. 13 is a diagram showing the amount of light at the time of writing with the laser beam after the light passes through the filter.

The fact that application of the filter mechanism to each toner selection light provides an enormous advantage will be described with reference to FIGS. 8 to 13. FIG. 8 is a diagram showing a light movement curve. In FIG. 8, the horizontal axis indicates the electric field intensity (V/cm); the vertical axis, the amount of light (mJ); the right side, a region where particles migrate; and the left side, a region where the particles do not migrate. The electric field intensity changes with exposure of a photosensitive body with a laser beam. Specifically, two kinds of electric field intensities, A and B shown in FIG. 8, can be produced. If light whose amount of light is C is irradiated, the migration of particles can be controlled by switching between the electric field intensities A, B. However, in a system in which the photosensitive body is exposed by a laser beam 602 from the back while irradiated by a line-like halogen lamp 601 as shown in FIG. 9, the amount of light which defines writing differs between point a and point b. More specifically, the amount of light at point b is larger as shown in FIG. 10. At the end of exposure by the laser beam, particles migrate neither at point a nor at point b, thereby imposing no problem. However, at the start of exposure, the density at point b is larger, which is a problem. It is for this reason that the filter mechanism 702 is introduced in the invention as shown in FIG. 11. The filter has a higher transmittance at a portion corresponding to point a and a lower transmittance at point b as shown in FIG. 12. FIG. 13 is a diagram showing the amounts of light at the time of writing with the laser beam after the light has passed through the filter. The amounts of light at points a, b are equal. As a result of the introduction of the filter, it has been verified that images whose density is stable at any position can be produced.

Although a structure that the halogen lamp is moved as a spot light source in synchronism with a laser beam is conceivable as a means for differentiating from the invention, such a structure imposes the problems to be overcome including fog due to the light source, mechanical accuracy, and fabrication cost. Thus, the invention is superior to such a structure in these points.

According to the invention, the color of toner to be developed can be selected only by switching the toner selection lights using the toner selection light irradiating mechanism even if an image is exposed by a single electrosensitive layer exposing mechanism. Therefore, it is no longer required that the electrophoretic imaging device have a plurality of electrosensitive layer exposing mechanisms per color, nor is it required that a different developing solution be used per color, hence allowing a color imaging device with a simple construction to be achieved.

Further, the light-shielding layer is arranged on the side at which the electrosensitive layer is in contact with the developing solution, thereby contributing to reducing crosstalk that the electrosensitive layer exposing light sensitizes the toner or that the toner selection light sensitizes the electrosensitive layer. This expands not only the freedom in selecting the materials of the electrosensitive layer and toner from the spectral response viewpoint, but also the freedom in selecting the toner selection light and electrosensitive layer exposing light.

Still further, the electric charge transferring layer that is light-shielding is used, thereby contributing to reducing the crosstalk that the electrosensitive layer exposing light sensitizes the toner or that the toner selection light sensitizes the electrosensitive layer. This expands not only the freedom in selecting the materials of the electrosensitive layer and toner from the spectral response viewpoint, but also the freedom in selecting the toner selection light and electrosensitive layer exposing light.

Still further, the light-shielding layer is arranged between the electric charge transferring layer and the photoelectric charge generating layer, thereby contributing to reducing the crosstalk that the electrosensitive layer exposing light sensitizes the toner or that the toner selection light sensitizes the electrosensitive layer. This expands not only the freedom in selecting the materials of the electrosensitive layer and toner from the spectral response viewpoint, but also the freedom in selecting the toner selection light and electrosensitive layer exposing light.

Still further, the filter is applied to each toner selection light, thereby allowing an imaging device capable of producing high-quality images whose density is stable to be realized with a simple construction.

What is claimed is:

1. An electrophoretic imaging device, comprising:

an electrosensitive layer;

an insulating body being arranged to confront said electrosensitive layer, said electrosensitive layer and said insulating body allowing a developing solution to be filled therebetween said developing solution being prepared by dispersing at least two kinds of electrosensitive toners into an insulating solvent;

means for applying a voltage between said electrosensitive layer and said insulating body;

means for irradiating said developing solution with a toner selection light, said toner selection light causing at least one kind of said electrosensitive toner to be selectively sensitized; and electrosensitive layer exposing means for causing image data to be photosensitively written to said electrosensitive layer;

wherein said electrosensitive layer comprises a photoelectric charge generating layer and a light-shielding layer, said light-shielding layer being arranged closer to said insulating body than said photoelectric charge generating layer; and wherein said light-shielding layer of said electrosensitive layer comprises an electric charge transferring layer having a light-shielding property.

2. An electrophoretic imaging device, comprising:

an electrosensitive layer;

an insulating body being arranged to confront said electrosensitive layer, said electrosensitive layer and said insulating body allowing a developing solution to be filled therebetween, said developing solution being prepared by dispersing at least two kinds of electrosensitive toners into an insulating solvent;

means for applying a voltage between said electrosensitive layer and said insulating body;

means for irradiating said developing solution with a toner selection light, said toner selection light causing at least one kind of said electrosensitive toner to be selectively sensitized; and electrosensitive layer exposing means for causing image data to be photosensitively written to said electrosensitive layer;

wherein said electrosensitive layer comprises a photoelectric charge generating layer and a light-shielding layer, said light-shielding layer being arranged closer to said insulating body than said photoelectric charge generating layer; and wherein said electrosensitive layer further comprises an electric charge transferring layer which is arranged closer to said insulating body than said light-shielding layer.

3. An electrophoretic imaging device, comprising:

an electrosensitive layer;

an insulating body being arranged to confront said electrosensitive layer, said electrosensitive layer and said insulating body allowing a developing solution to be filled therebetween, said developing solution being prepared by dispersing at least two kinds of electrosensitive toners into an insulating solvent;

means for applying a voltage between said electrosensitive layer and said insulating body;

means for irradiating said developing solution with a toner selection light, said toner selection light causing at least one kind of said electrosensitive toner to be selectively sensitized; and electrosensitive layer exposing means for causing image data to be photosensitively written to said electrosensitive layer;

wherein said electrosensitive layer comprises a photoelectric charge generating layer and an electric charge transferring layer having a light-shielding property, said electric charge transferring layer being arranged closer to said insulating body than said photoelectric charges generating layer; and wherein said toner selection light irradiating means is provided with filter means having different transmittances corresponding to the density of light irradiated by said toner selection light irradiating means.

* * * * *